US006671932B1

(12) United States Patent
Brugniaux

(10) Patent No.: US 6,671,932 B1
(45) Date of Patent: Jan. 6, 2004

(54) DEVICE FOR MAINTAINING SHEETS, CARDS AND THE LIKE, CAPABLE OF BEING FIXED ON A RIGID SUPPORT

(76) Inventor: Maxime Brugniaux, 215 avenue du Maréchal De Lattre de Tassigny, 93260 Les Lilas (FR), F-75018

( * ) Notice: Subject to any disclaimer, the term of this patent is extended or adjusted under 35 U.S.C. 154(b) by 0 days.

(21) Appl. No.: 09/959,958

(22) PCT Filed: May 5, 2000

(86) PCT No.: PCT/FR00/01212

§ 371 (c)(1),
(2), (4) Date: Jan. 30, 2002

(87) PCT Pub. No.: WO00/68919

PCT Pub. Date: Nov. 16, 2000

(30) Foreign Application Priority Data

May 10, 1999 (FR) ..... 99 05941
Aug. 27, 1999 (FR) ..... 99 10839
Feb. 16, 2000 (FR) ..... 00 01886

(51) Int. Cl.[7] ..... G09F 1/10
(52) U.S. Cl. ..... 24/67.3; 24/67 R; 24/304
(58) Field of Search ..... 24/67 R, 67.3, 24/67.9, 67.4, 67 AR, DIG. 8, DIG. 9, 304, DIG. 11, 336, 531; 281/45; 211/45; 248/316.7; 40/658

(56) References Cited

U.S. PATENT DOCUMENTS 813,468 A * 2/1906 Tutt ..... 40/658
1,099,698 A * 6/1914 Glotfelty ..... 211/30
1,224,317 A * 5/1917 Parkhurst ..... 40/658
3,797,795 A * 3/1974 Hemgren ..... 248/316.7
4,010,517 A * 3/1977 Kapstad ..... 24/67.11

FOREIGN PATENT DOCUMENTS

| | | | | |
|---|---|---|---|---|
| DE | 490 453 | | 1/1930 | |
| DE | 490453 C | * | 1/1930 | |
| EP | 0 350 342 | | 1/1990 | |
| EP | 350342 A | * | 1/1990 | ..... A47G/1/17 |
| FR | 1 485 828 | | 9/1967 | |
| FR | 1485828 A | * | 9/1967 | |
| GB | 2092525 A | * | 8/1982 | ..... F16B/2/22 |

* cited by examiner

*Primary Examiner*—James R. Brittain
(74) *Attorney, Agent, or Firm*—Young & Thompson

(57) ABSTRACT

A device for holding sheets, cards or the like, capable of being applied on a support S includes a relatively stiff front plate 1, a pellet 4, elements 7 for fixing face 5 of pellet 4 onto face 2 of front plate 1, at least two elastic tabs 11, 12 and elements for mounting both tabs cooperatively with the front plate 1 so that these tabs are able to apply, through a first one 31, 32 of both their ends, elastic forces on points located on two distinct lines 13, 14 against a reaction exerted by their second end 33, 34 on the first face 2 of front plate 1, and so that the cylindrical volume 15 generated by a generatrix G substantially perpendicular to face 2 of front plate 1 and resting on the convex polygon 16 formed by both lines 13, 14 and two straight lines 17, 18 joining both ends 19, 21–20, 22 of both these lines 13, 14, respectively, has a cross-section at most equal to the surface area of face 2 of front plate 1 and greater than the surface area of face 6 of pellet 4, and so that the pellet 4 is located within the cylindrical volume 15, substantially at its center.

18 Claims, 2 Drawing Sheets

DEVICE FOR MAINTAINING SHEETS, CARDS AND THE LIKE, CAPABLE OF BEING FIXED ON A RIGID SUPPORT

BACKGROUND OF THE INVENTION

The present invention relates to devices for holding sheets, cards or the like, capable of being applied on a rigid support.

Devices for holding sheets, cards or the like are already known. For instance, such devices are described in the following documents: U.S. Pat. Nos. 3,828,402, 4,478,384 and 3,797,795, GB-A-2 092 525 and FR-A-2 602 899.

The devices described in these documents enable one or two sheets, cards or the like to be held on a given support, but they notably suffer from the drawback of accepting such sheets only when they are introduced according to one or two preferential directions. In other words, they do not accept to hold sheets whatever their direction of introduction.

A device is also known for holding sheets, cards or the like relatively to a support, wherein the sheets may be introduced according to an infinite number of directions in fact distributed over three hundred and sixty degrees. Such a device is described in GB-A-2 129 296.

The device described in this document comprises a front plate built out of an elastically deformable material, a support and a spot of glue for binding the front plate, substantially at its center, with the support. This device allows for multidirectional introduction of sheets, all around the spot of glue, between the front plate and the support, but it also suffers from drawbacks. First of all, it may only hold sheets which have a thickness slightly greater than the defined space between the front plate and the support. Furthermore, introduction of sheets, cards or the like between the front plate and the support may prove to be difficult, with even the risk of damaging the sheets and even the front plate. Furthermore, this device has a relatively short life time. Indeed, successive deformations undergone by the front plate damage it rather rapidly, which prevents it from playing its role of holding the sheets and bearing information, for example advertising information, if it was bearing inscriptions, logos, etc.

SUMMARY OF THE INVENTION

Accordingly, the object of the present invention is to produce a device which largely overcomes the drawbacks of the aforementioned prior art devices.

The object of the present invention is also to produce a device for holding sheets, cards or the like, which may be very easily applied on any support, regardless of the nature and shapes of these supports, of course within certain limits.

More specifically, the object of the present invention is a device for holding sheets, cards or the like, capable of being applied on a rigid support, comprising:

- a front plate having two opposite faces, a first and a second one
- a pellet having a substantially cylindrical general shape of a determined height and of a cross-section less than the surface area of the first face of the front plate, said pellet having two opposite end faces, a first and a second one, first means for fixing the first end face of the pellet onto the first face of the front plate, and
- second means for fixing the second end face of the pellet onto the support, characterized in that:

- said front plate is relatively stiff, and it further comprises:

- at least two elastic tabs, and
- means for mounting both said tabs cooperatively with said front plate such that, on the one hand, these two tabs are able to apply, through a first one of both their ends, elastic forces on points located on two distinct lines, against a reaction exerted by their second end on the first face of said front plate and, on the other hand, so that the cylindrical volume generated by a generatrix substantially perpendicular to the first face of said front plate and resting on the convex polygon formed by both said lines and two straight lines joining both ends of both said lines, respectively, has a cross-section at most equal to the surface area of the first face of the front plate and greater than the surface area of the second end face of said pellet, and so that said pellet is located within said cylindrical volume at its center.

BRIEF DESCRIPTION OF THE DRAWINGS

Other characteristics and advantages of the invention will become apparent from the following description given with reference to illustrative but non-limiting appended drawings, wherein:

FIGS. 1 and 2 show two views of a preferred embodiment of the device according to the invention for holding sheets, cards or the like, capable of being applied on a rigid support, wherein FIG. 1 is a bottom view and FIG. 2 is a sectional view along line II—II as referenced in FIG. 1.

DETAILED DESCRIPTION OF THE PREFERRED EMBODIMENT

Figure 1:
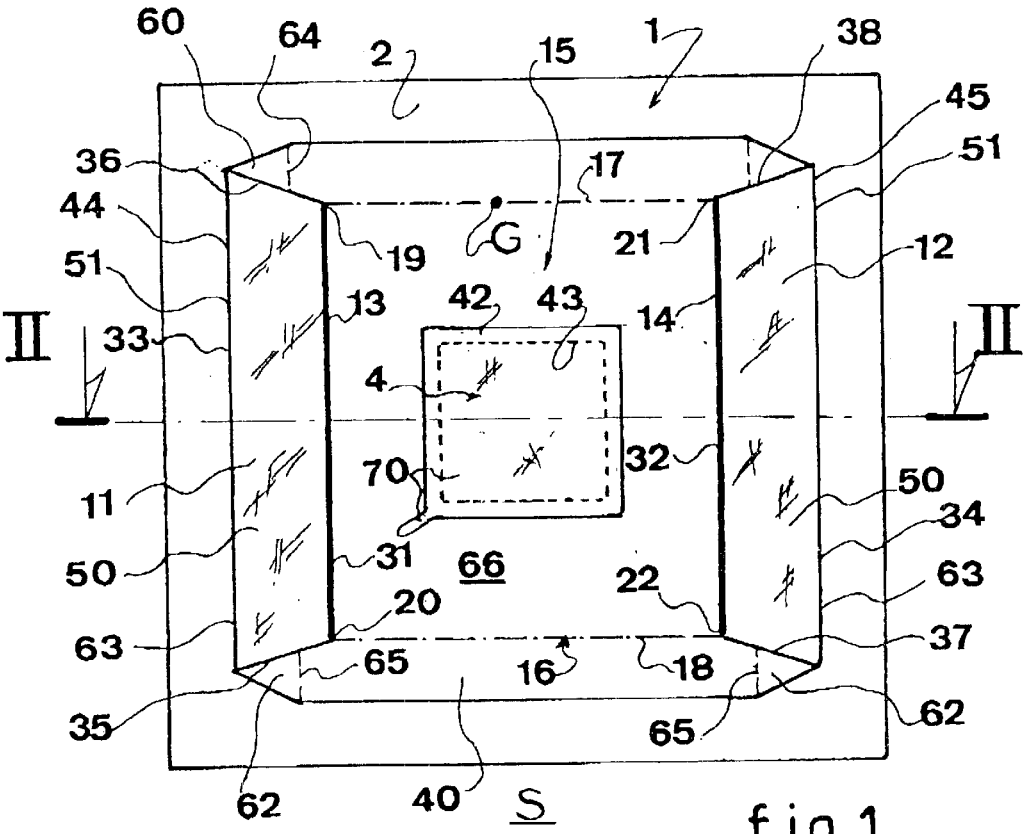

It is specified that the three figures represent a same embodiment. Accordingly, the same references designate the same elements therein, whichever the figure on which they appear and regardless of the representation shape of these elements. Also, if the elements are not specifically referenced on one of the figures, their references may easily be found again by referring to another figure.

It is also specified that, when, according to the definition of the invention, the object of the invention comprises "at least one" element having a given function, the described embodiment may comprise several of these elements.

Similarly, if the embodiment of the object according to the invention as illustrated, comprises several elements having an identical function and if, in the specification, it is not specified that the object according to this invention should necessarily comprise a particular number of these elements, the object of the invention may be defined as comprising "at least one" of these elements.

The device according to the invention is capable of being applied on a rigid support S, for example a computer frame, a tray, a frame, etc. and enables sheets, cards or the like, $F_1$, $F_2$, $F_3$, $F_4$ . . . to be held relatively to this support.

The device comprises a front plate 1 comprising two opposite faces 2, 3, i.e. a first and a second one and a pellet 4 advantageously with a substantially cylindrical general shape having a determined height h and a cross-section less than the surface area of the first face 2 of front plate 1. In the illustrated preferred embodiment, this pellet assumes the shape of a cube or a right-angled parallelepiped. It comprises two opposite end faces 5, 6, a first and a second one.

It is clearly specified that the cylindrical shape of the pellet should not be interpreted in a strictly mathematical sense, but as a hint defining a general shape for this pellet.

The device further comprises first means 7 for fixing the first end face 5 of pellet 4 on the first face 2 of front plate 1 and second means 8 for fixing the second end face 6 of pellet 4 on support S.

Preferably, the front plate 1 is relatively stiff. It comprises for example, a plastic plate, for example either rectangular or square, or the like, such as a PVC plate, wherein this plate further has a relatively large thickness so as to impart a certain stiffness and also adequate strength to it.

The device further comprises at least two elastic tabs 11, 12 and means for mounting these two tabs cooperatively with the front plate 1 so that, on the one hand, both these tabs are able to apply, through a first one 31, 32 of both their ends, elastic forces on points located on two distinct lines 13, 14, against a reaction exerted by their second end 33, 34 on the first face 2 of the front plate 1 and, on the other hand, so that the cylindrical volume 15 generated by a generatrix G substantially perpendicular to the first face 2 of the front plate 1 and resting on the convex polygon 16 formed by both lines 13, 14 and two straight lines 17, 18 joining both ends 19,21–20,22 of both lines 13, 14, respectively, has a cross-section at most equal to the surface area of the first face 2 of front plate 1 and greater than the surface area of the second end face 6 of pellet 4, and so that this pellet is located within the cylindrical volume 15, substantially at its center.

In this way, with the above defined structure, the length of at least one of both lines 13, 14, and advantageously both of them, is greater than the greatest of the dimensions of the second face 6 of the pellet 4.

In the illustrated examples, the convex polygon 16 assumes the preferred shape of a rectangle or a square, but it is clearly obvious that it may assume other shapes, preferably similar to the one of the front plate 1.

Similarly, a tab may be formed by a combination of several tabs placed side by side and in contact with one another or not, but however without them being too distant from one another, so that their first ends define a line 13, 14 which is substantially continuous or which may in any case be comparable to a continuous line.

In the sense of the present specification, it is also clearly understood that both lines 13, 14, may be straight, curved, continuous or discontinuous, although they have been illustrated as rectilinear and continuous in the figures.

Figure 2:
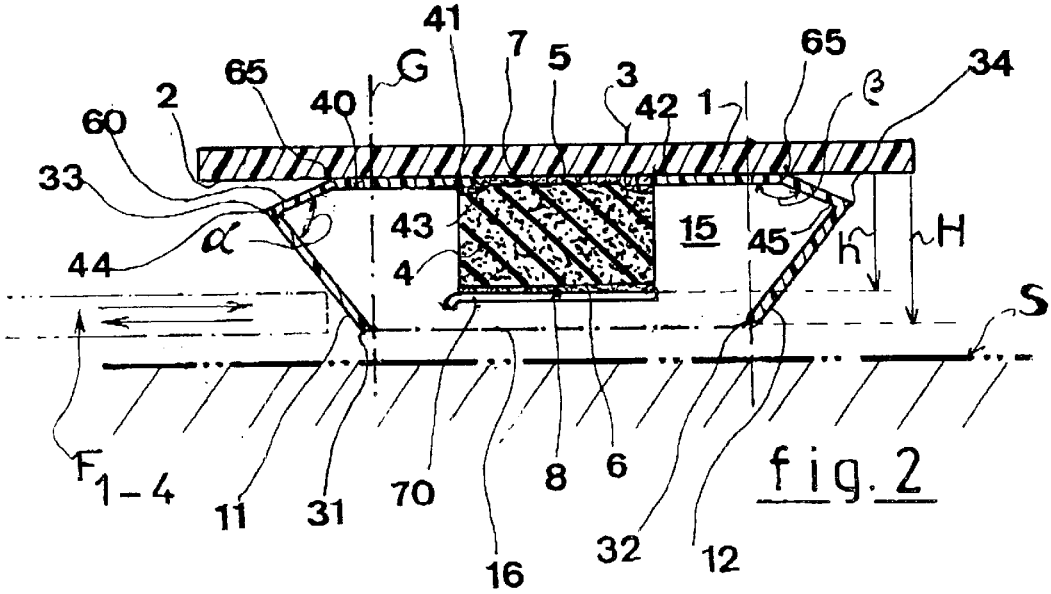
Figure 3:
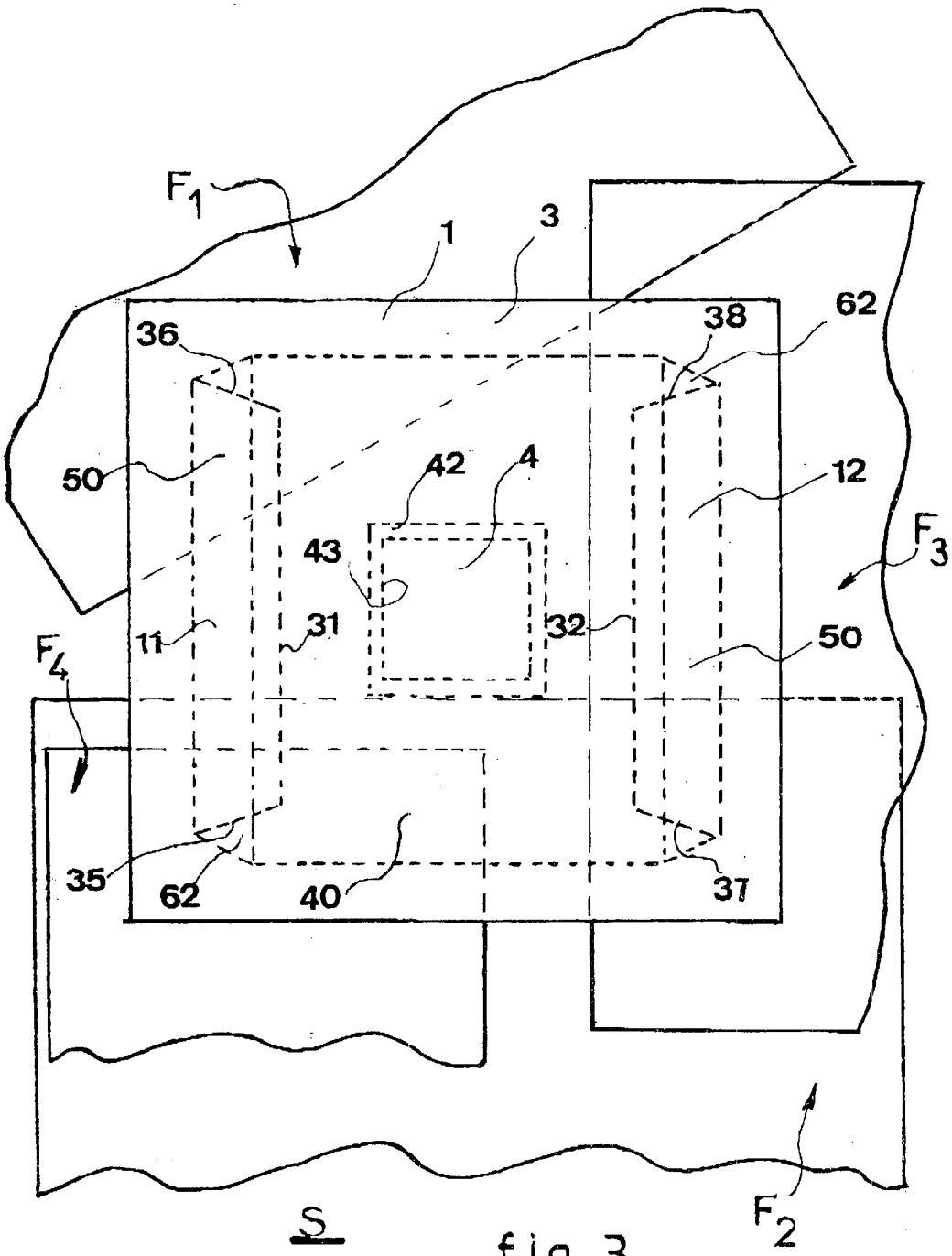
FIG. 3 shows a top view of the embodiment according to FIGS. 1 and 2, for demonstrating the results which may be obtained with the device according to the invention, i.e. holding a plurality of sheets arranged according to any direction in a plane.

It is therefore possible, according to the above described structure, to fix the second end face 6 of pellet 4 on support S and to introduce sheets, cards or the like $F_{1-4}$, cf. FIGS. 2 and 3, between the first ends 31, 32 of tabs 11, 12 and support S, whereby these tabs are elastically deformed by reaction against the first face 2 of front plate 1 which is relatively stiff.

The device described above has unquestionable advantages with respect to prior art devices of the same type. For example, the sheets may be nipped regardless of their thickness between zero and the height h of the pellet 4. The front plate is not subject to any major deformation and its second face 3 may therefore comprise inscriptions, logos, etc. which will remain legible for a very long time. Moreover, as it may be seen in FIG. 3 perfectly, a plurality of sheets or the like $F_{1-4}$, may be introduced according to a plurality of directions with respect to the center of front plate 1.

In a possible embodiment which has not been specifically illustrated but may be deduced from FIGS. 1–3 without any difficulty, the elastic tabs 11, 12 are directly secured to the first face 2 of front plate 1 through their second end 33, 34. These tabs may be of any nature, for example comprising rolls made of elastic material, wherein these rolls are fixed for example, by a glue onto the first face 2 of front plate 1, this glue forming, in this case, means for mounting both tabs 11, 12 cooperatively with front plate 1.

However, in an advantageous embodiment, as more particularly illustrated in FIGS. 1–3, means for mounting both tabs 11, 12 cooperatively with front plate 1, comprise a counter-plate 40 and means 41 for securing, at least in one point, the counter-plate 40 with the first face 2 of front plate 1, both these tabs 11, 12 being secured to the counter-plate 40 by their second end 33, 34.

Furthermore, these securing means 41 are advantageously formed by a portion 42 of the counter-plate 40 which is interposed between the first end face 5 of pellet 4 and the first face 2 of front plate 1. Still advantageously, this portion 42 comprises a through-hole 43, the cross-section of which is less than the surface area of the first end face 5 of pellet 4, so that the first fixing means 7 are able to bind at least a portion of this first end face with the first face 2 of front plate 1 by confining portion 42 of counter-plate 40 between the first pellet end face 5 and the first front plate face 2.

Preferably, the counter-plate 40 and both tabs 11, 12 are made of the same elastic material sheet, for example a PVC sheet, polypropylene sheet, etc. In this case, both tabs 11, 12 are obtained by folding two opposite edges of the sheet along two folding lines 44, 45, respectively.

Advantageously, this folding is performed in such a way that the plane of each tab 11, 12 forms with the plane of the sheet portion forming the counter,15 plate 40, a first dihedron with an apex angle $\alpha$ less than a right angle, for example equal to forty-five degrees. The tab configuration according to this feature, facilitates the introduction of the sheets between the first ends 31, 32 of the tabs and support S, because the tabs are inclined in the direction for introducing the sheets and their elastic deformation will be equivalent to a rotation substantially centered on their second end 33, 34, as may be seen in FIG. 2.

With the aim of always having the first ends 31, 32 of both tabs 11, 12 respectively in contact with support S when the second face 6 of pellet 4 is secured to this support, it is advantageous, as more specifically illustrated in FIG. 2, if the distance H between the first end 31, 32 of at least a tab 11, 12 and the first face 2 of front plate 1 is greater than the height h of pellet 4, when the tab is not subject to any deformation force.

Of course, the width of the tabs, taken perpendicularly to their ends 31, 32 and 33, 34 is preferably less than the distance which separates pellet 4 from the second ends 33, 34 of these tabs, so that, upon elastic deformation of the tabs by folding when the sheets $F_{1-4}$, are introduced as mentioned heretofore, the first ends 31, 32 of the tabs do not come and abut against the pellet 4.

As mentioned earlier, this device may hold a plurality of sheets which may be introduced all around the pellet 4. Moreover, it is obvious that the sheets which are introduced perpendicularly to lines 13, 14, defined above, as for example sheet $F_3$, and possibly sheet $F_1$, in FIG. 3, are perfectly guided so that they are placed between the tabs and support S because of the inclination of tabs towards the inside of volume 15.

On the other hand, sheets which would be introduced perpendicularly to the straight lines 16, 17 defined above, i.e. in parallel to lines 13, 14, might come and abut against sides 35, 36 of tab 11 connecting its ends 31, 33 and against sides 37, 38 of tab 12 connecting its ends 32, 34.

In order to favor introduction of the sheets in parallel with lines 13, 14, and so with ends 31–34 of tabs 11, 12, at least one of both the tabs 11, 12, and advantageously both of them, assume a first substantially trapezoidal 50, preferably isosceles, general shape, wherein each tab is secured to the counter-plate 40 through its large base 51. In this case, the aforementioned folds 44, 45 are defined on the large base 51 of the trapezoidal shapes 50.

With this structure, sides 35–38 of both tabs 11, 12 are inclined towards the inside of volume 15 and somewhat form ramps, over which the edges of the sheets, like sheets $F_2$ and $F_4$ in FIG. 3, will slide towards the support S, in order to be inserted just between the first ends 31, 32 of the tabs and this support, and then be held by a nip.

As mentioned earlier, if the counter-plate 40 and both tabs 11, 12 are made out of a same sheet of elastically deformable material, the portion of the counter-plate 40 which lies on the borders of both tabs, because of the internal stresses generated by the folding, tends to depart from the first face 2 of front plate 1. This distance is larger when the angle $\alpha$ is small, with the risk of letting a sheet be introduced between front plate 1 and counter-plate 40.

In order to aim at avoiding this possibility, first of all, the edges 60 of counter-plate 40 through which tabs 11, 12 of a substantially trapezoidal shape 50 are secured, have a length equal to that of the large base 51 of this trapezoidal shape 50. Furthermore, sheet portions 61 of which the edges 60 form a part, each assume a second substantially trapezoidal 62, advantageously isosceles shape, the small base 63 of which coincides with the large base 51 of the first substantially trapezoidal shape 50, wherein the counter-plate 40 exhibits, at the large bases 64 of these second trapezoidal shapes 62, a fold 65 so that each of the sheet portions 61 and the remaining portion 66 of counter-plate 40 form a second dihedron with an apex angle $\beta$ of a value greater than that of a right angle. In this case, it is therefore advantageous when the sum of the apex angles $\alpha+\beta$ of the first and second dihedrons is less than 270 degrees so that the tabs 11, 12 have a position as illustrated in the figures, which facilitates introduction of the sheets $F_{1-4}$, as described previously.

As described earlier, the sides of these second trapezoidal shapes 62 somewhat form guiding ramps for the edges of the sheets, first of all, towards sides 35–38 of tabs 11, 12 then between support S and first ends 31, 32 of tabs 11, 12.

It is clearly specified that the expression "trapezoidal" used above is only given in order to facilitate the present description, by defining the general shape of tabs 11 and 12 and portions of sheet 61. However, it is clearly understood that this expression should not be strictly interpreted in the mathematical sense, and so it may encompass other related or equivalent shapes which will have the same function.

In an advantageous embodiment, pellet 4 comprises a block of elastically deformable material, for example expansed plastic material or the like which has the feature of being relatively flexible and elastic so as to allow front plate 1 to swing over, when one of the introduced sheets F has a thickness greater than the height h of this pellet, and thus prevent the device and the supports from separating.

As to the first and second fixing means 7, 8, they comprise two adhesive layers applied to the first 5 and second 6 end faces of the pellet, respectively, facilitating assembly of the device and application of this device on any support S.

The above described device may be used on a great number of supports as those mentioned heretofore. Also, in order to be able to transport it without impairing its integrity, notably without damaging the adhesive layer applied to the second face 6 of pellet 4, this layer is for example covered with a removable protective slip 70. This slip, which is stuck on the adhesive layer applied to the second end face of the pellet, is then removed just before applying the device according to the invention on a given support by gluing the second face 6 of the pellet on this support.

What is claimed is:

1. A device for holding sheets, cards or the like, capable of being applied on a rigid support, consisting of:

a relatively stiff front plate comprising two opposite faces, a first and a second one, a pellet with a substantially cylindrical general shape having a determined height and a cross-section less than the surface area of the first face of the front plate, said pellet comprising two opposite end faces, a first and a second one, at least two elastic tabs, first means for fixing the first end face of said pellet onto the first face of the front plate, and second means for fixing the second end face of said pellet onto support, said device further comprising means for mounting both said tabs cooperatively with said front plate, said means for mounting comprising a counter-plate and means for securing, at at least one end point, said counter-plate with the first face of the front plate, wherein both said tabs are secured to said counter-plate through a second end, wherein said means for securing said counter-plate with the first face of the front plate consists of a portion of said counter-plate interposed between the first end face of the pellet and the first face of the front plate so that, on the one hand, each of these tabs is able to apply, by a first one of both their opposite ends, elastic forces against the support on points located on a distinct line, against a reaction exerted by its second opposite end on the first face of said front plate, the first end being closer to the pellet than the second end in order to constitute, in addition, an inclined guide toward the first end for the introduction of sheets, cards or the like, and, on the other hand, so that the cylindrical volume generated by a generatrix substantially perpendicular to the first face of said front plate and resting on the convex polygon formed by both said lines and two straight lines joining both ends of both said lines, has a cross-section at most equal to the surface area of the first face of the front plate and greater than the surface of the second end face of said pellet and so that said pellet is located within said cylindrical volume, substantially at its center.

2. A device according to claim 1, characterized in that said portion of said counter-plate interposed between the first end face of said pellet and the first face of the front plate comprises a through-hole, wherein the cross-section of said through-hole is less than the surface area of the first end face of said pellet, so that the first fixing means are able to bind at least a portion of the first end face of said pellet with the first face of the front plate by confining said portion of said counter-plate between the first pellet end face and the first face of the front plate.

3. A device according to claim 1, wherein said counter-plate and both tabs are made out of a same sheet of elastic material.

4. A device according to claim 3, wherein both said tabs are obtained by folding two opposite edges of said sheet along two folding lines, respectively.

5. A device according to claim 4 wherein the folding of said sheet along both folding lines is performed in such a way that the plane of each tab forms, with the plane of the sheet portion forming the counter-plate, a first dihedron with an apex angle ($\alpha$) less than a right angle.

6. A device according to claim 5, wherein the distance between the first end of at least a tab and the first face of said front plate, when said tab is not subject to any deformation force, is greater than the height of said pellet.

7. A device according to claim 4, wherein at least one of both tabs has a first substantially trapezoidal general shape, wherein said tab is secured to said counter-plate through the large base of this first trapezoidal shape.

8. A device according to claim 7, wherein the folding line is defined on the large base of the first trapezoidal shape of said tab.

9. A device according to claim 8, wherein the edge of said counter-plate through which said tab is secured to the first substantially trapezoidal shape, has a length equal to that of the large base of this first trapezoidal shape.

10. A device according to claim 9, wherein the sheet portion of which is part the edge of said counter-plate through which the tab is secured, has a second substantially trapezoidal shape, the small base of which coincides with the large base of the first substantially trapezoidal shape, wherein the counter-plate has, at the large base of this second trapezoidal shape, a fold so that this sheet portion and the remaining portion of said counter-plate form a second dihedron with an apex angle ($\beta$) of a value greater than that of a right angle.

11. A device according to claim 10, wherein the sum of apex angles ($\alpha+\beta$) of the first and second dihedrons is less than 270 degrees.

12. A device according to claim 1, wherein said pellet comprises a block of elastic deformable material and that first and second fixing means comprise two adhesive layers applied to the first and second end faces of said pellet, respectively.

13. A device according to claim 12, wherein said elastic deformable material comprises foam.

14. A device according to claim 12, wherein said device further comprises a removable protection slip stuck onto the adhesive layer applied to the second end face of said pellet.

15. A device according to claim 1, wherein said elastic tabs are secured, through their second end, to the first face of said front plate.

16. A holding device for connection to a rigid support, said device comprising:

a relatively stiff front plate having first and second opposing faces;

a pellet having a determined height and a cross-section less than a surface area of the first face, said pellet having first and second opposite end faces, said first end face being fixedly adhered onto said first face, said second end face being fixedly adherable onto the support; and at least two elastic tabs extending from said front plate, wherein said tabs are structured and arranged to cooperate with said front plate so that, each of said tabs applies an elastic force at a free first end against the support on points located on a distinct line, against a reaction exerted by a second opposite end on the first face of said front plate, and wherein the first end is closer to the pellet than the second end so that each said tab is inclined toward the pellet, said pellet being located between said at least two tabs substantially at a center of said front plate.

17. A holding device for connection to a rigid support, said device comprising:

a relatively stiff front plate having first and second opposing faces;

a pellet having a determined height and a cross-section less than a surface area of the first face, said pellet having first and second opposite end faces, said first end face being fixedly adhered onto said first face, said second end face being fixedly adherable onto the support;

at least two elastic tabs extending from said front plate, said tabs having a first and second ends; and a counter-plate secured to the first face of the front plate, said tabs being secured to said counter-plate through each said second end, wherein said tabs are structured and arranged to cooperate with said front plate so that each of said tabs applies an elastic force at said first end against the support on points located on a distinct line, against a reaction exerted by said second end on the first face of said front plate, wherein the first end is closer to the pellet than the second end so that each said tab is inclined toward the pellet, said pellet being located between said at least two tabs substantially at a center of said front plate, and wherein said counter-plate and said tabs are made out of a same sheet of elastic material.

18. A device according to claim 17, wherein at least one of both tabs has a first substantially trapezoidal general shape, wherein said tab is secured to said counter-plate through the large base of this first trapezoidal shape.

* * * * *